US007678338B2

(12) United States Patent
Sleeper

(10) Patent No.: US 7,678,338 B2
(45) Date of Patent: Mar. 16, 2010

(54) FLUID RETAINING ASSEMBLY AND METHOD OF USING THE SAME

(75) Inventor: Gregory D. Sleeper, Colchester, VT (US)

(73) Assignee: General Dynamics Armament and Technical Products, Burlington, VT (US)

( * ) Notice: Subject to any disclaimer, the term of this patent is extended or adjusted under 35 U.S.C. 154(b) by 547 days.

(21) Appl. No.: 11/399,462

(22) Filed: Apr. 7, 2006

(65) Prior Publication Data

US 2007/0237687 A1 Oct. 11, 2007

(51) Int. Cl.
*B01L 9/00* (2006.01)

(52) U.S. Cl. ..... 422/104; 211/13.1; 206/524.1

(58) Field of Classification Search ..... 422/104
See application file for complete search history.

(56) References Cited

U.S. PATENT DOCUMENTS

| | | | | |
|---|---|---|---|---|
| 4,724,585 | A * | 2/1988 | Whitman | 24/195 |
| 4,797,260 | A * | 1/1989 | Parker | 422/101 |
| 6,118,582 | A * | 9/2000 | Del Buono | 359/398 |
| 6,372,484 | B1 * | 4/2002 | Ronchi et al. | 435/287.2 |

OTHER PUBLICATIONS

"Guide for the Selection of Biological Agent Detection Equipment for Emergency First Responders, Volume II," Saver Reprint, National Institute of Standards and Technology, SA-NIST-2005-06-BGRPT, May 2005, (26 pages).

"Joint Biological Point Detection System (JBPDS) Imprint Maintenance Model," Manprint Practitioner's Workshop, MAJ Adam Stroup, Ph.D, DSN 298-5973, Mr. Alan Dorney, DSN 298-5830, USARL-HRED, APG, MD, 21005-5425 Feb. 5, 2003, (23 pages).

"Chemical & Biological Detectors Newsletter," NAVSEA, vol. 1, May 2005 (4 pages).

"JBPDS, joint biological point detection system," General Dynamics Armament and Technical Products, Charlotte, NC 28217, www.gdatp.com; 2005 (2 pages).

"JBPDS, Joint Biological Point Detection System," General Dynamics Armament and Technical Products, www.gdatp.com/products/detection_systems/JBPD/JBPDS.htm, Mar. 31, 2006, (2 pages).

* cited by examiner

*Primary Examiner*—Yelena G Gakh
*Assistant Examiner*—Dirk Bass
(74) *Attorney, Agent, or Firm*—Hunton & Williams LLP

(57) ABSTRACT

The invention provides a fluid retaining assembly. In accordance with one embodiment of the invention, the fluid retaining assembly may include a base assembly including a cavity and a reservoir assembly disposed in the cavity of the base assembly. The reservoir assembly may include a body portion having a well in which fluid is retainable and a membrane covering the well. The reservoir assembly may further include an absorbent strip disposed in the well and covered by the membrane. The base assembly may be provided to include at least one attachment member. The attachment member serves to attach the reservoir assembly to the base assembly. A plurality of reservoir assemblies may be retained by the base assembly.

18 Claims, 9 Drawing Sheets

Test Card
(fluid retaining)
Assembly
10

200
reservoir assembly
200
130
clip retaining
bar
190
reservoir
retainer clip
192
lip
132
retaining groove
156
latch
154
retaining notches
152
support pedestal
120
supporting
bar
110
cavity
base assembly
100
400
membrane

FLUID RETAINING ASSEMBLY AND METHOD OF USING THE SAME

BACKGROUND OF THE INVENTION

Various systems are known that dispense fluids for purposes of inoculation. For example, such a system includes the Biological Point Detection System (JBPDS) as produced by General Dynamics Armament and Technical Products. Such an inoculation dispensing system typically dispenses the inoculation fluid using a set of needles. In operational use, such a system dispenses the inoculation fluid into an assay strip carrier card to determine the presence of biological agents.

As can be appreciated, it is very important that the appropriate volume of fluid being dispensed is accurately validated to ensure the proper operation of the biological detection system. To insure the appropriate volume of fluid is dispensed by the inoculation dispensing system, testing is conducted. Such testing includes the use of a test card that is inserted into the inoculation system in place of the operational assay strip carrier card, i.e., the test card is inserted for testing. The inoculation dispensing system dispenses inoculation into the test card, and the test card is removed. The volume of inoculation is then tested, i.e., how much inoculation did the inoculation dispensing system dispense.

However, the known test methods and other known test cards are lacking in the ability and ease by which this testing is performed. The invention addresses this need and others.

BRIEF SUMMARY OF THE INVENTION

The invention provides a fluid retaining assembly. In accordance with one embodiment of the invention, the fluid retaining assembly may include a base assembly including a cavity and a reservoir assembly disposed in the cavity of the base assembly. The reservoir assembly may include a body portion having a well in which fluid is retainable and a membrane covering the well. The membrane may provide sealing and prevent evaporation. The reservoir assembly may further include an absorbent strip disposed in the well and covered by the membrane. The base assembly may be provided to include at least one attachment member. The attachment member serves to attach the reservoir assembly to the base assembly. A plurality of reservoir assemblies may be retained by the base assembly.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of the test card assembly in accordance with various embodiments of the invention will be described. As used herein, any term in the singular may be interpreted to be in the plural, and alternatively, any term in the plural may be interpreted to be in the singular.

In accordance with one embodiment, the invention satisfies a particular need of providing a novel inoculation volume test card assembly. That is, the invention was developed to satisfy a design need of measuring inoculation volume sample fluid levels generated in the joint Biological Point Detection System (hereinafter the "JBPDS System") in-situ. The JBPDS System is produced by General Dynamics Armament and Technical Products. The JBPDS System is well known in the art. In development of the invention, it was recognized that a test card assembly is needed with removable reservoirs to replace the operational carrier strip card, i.e., when performing testing of the inoculation fluid amount dispensed. The novel test card assembly as described herein, in accordance with one embodiment of the invention, is used to perform such validation test operation of the JBPDS System. The test card assembly provides a device to verify that the JBPDS System collects, and inoculates an assay carrier with the required sample fluid amount to ensure that the JBPDS System can properly detect if a biological agent is present, in accordance with one aspect of the invention.

However, it is appreciated that the invention is not limited to such use as a test card. That is, the invention may be used in any application in which it is desired to retain a given fluid. In particular, the invention may be used in any mechanized application in which it is desired to retain a given fluid, dispersed by needle inoculation, for volume testing. Other similar applications could exist in testing for the biological sciences or similar biological detection systems since the use of assay strips is common and the volume inoculation of such strips must be verified to ensure the accuracy of detection.

In accordance with one aspect of the invention, the test card may be used to accurately determine the amount of fluid inoculated within +/−1 microliter. This capability may be provided by weighing the individual reservoirs of the test card before and after inoculation, and by providing an effective seal over the reservoir assemblies 200, for example. Further, it is noted that the test card dimensions may be modified as desired to fit the particular interface control dimensions.

Figure 1:
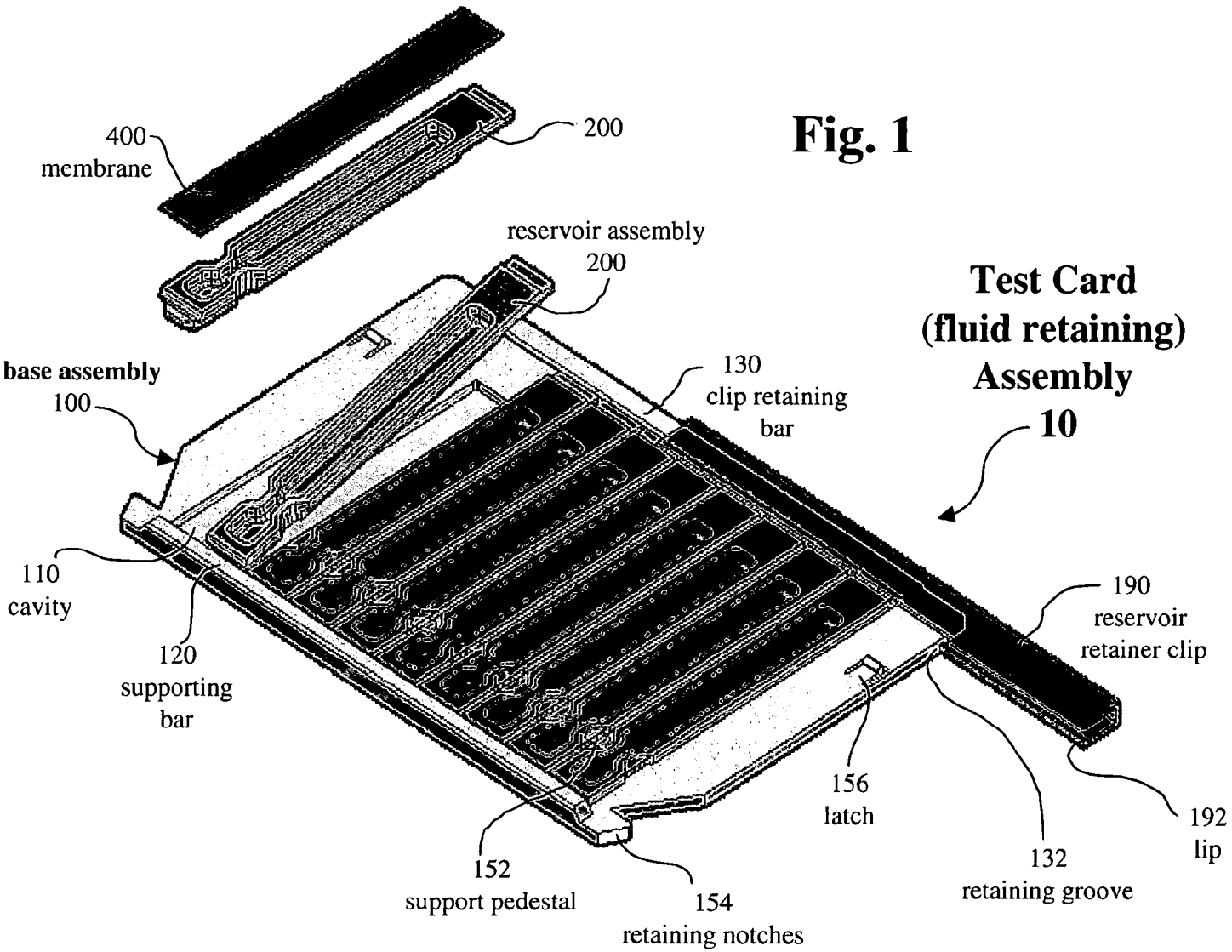
FIG. 1 is a perspective view of a test card assembly in accordance with one embodiment of the invention.

FIG. 1 is a perspective view of a fluid retaining assembly 10 in accordance with one embodiment of the invention. As described herein, the fluid retaining assembly 10 may be utilized in one embodiment as a test card assembly, i.e., for use in testing an inoculation unit such as the JBPDS System. As shown in FIG. 1, the fluid retaining assembly 10 includes a base assembly 100 and a plurality of reservoir assemblies 200. The reservoir assemblies 200 are disposed within and upon, and connected to, the base assembly 100 such that the base assembly 100 and the reservoir assemblies 200 form a unit. Each reservoir assembly 200 may be individually removed from the base assembly 100 as needed, such as for testing, e.g. weighing.

The base assembly 100 includes a supporting bar 120 and a clip retaining bar 130. Both the supporting bar 120 and the clip retaining bar 130 serve to secure the reservoir assemblies 200 upon and within the base assembly 100, as shown in FIG. 1. The fluid retaining assembly 10 also includes a reservoir retainer clip 190. The reservoir retainer clip 190 is mounted upon the clip retaining bar 130, as shown in FIG. 1. Further details of the supporting bar 120 and the clip retaining bar 130, as well as the reservoir retainer clip 190, are described below.

Figure 2:
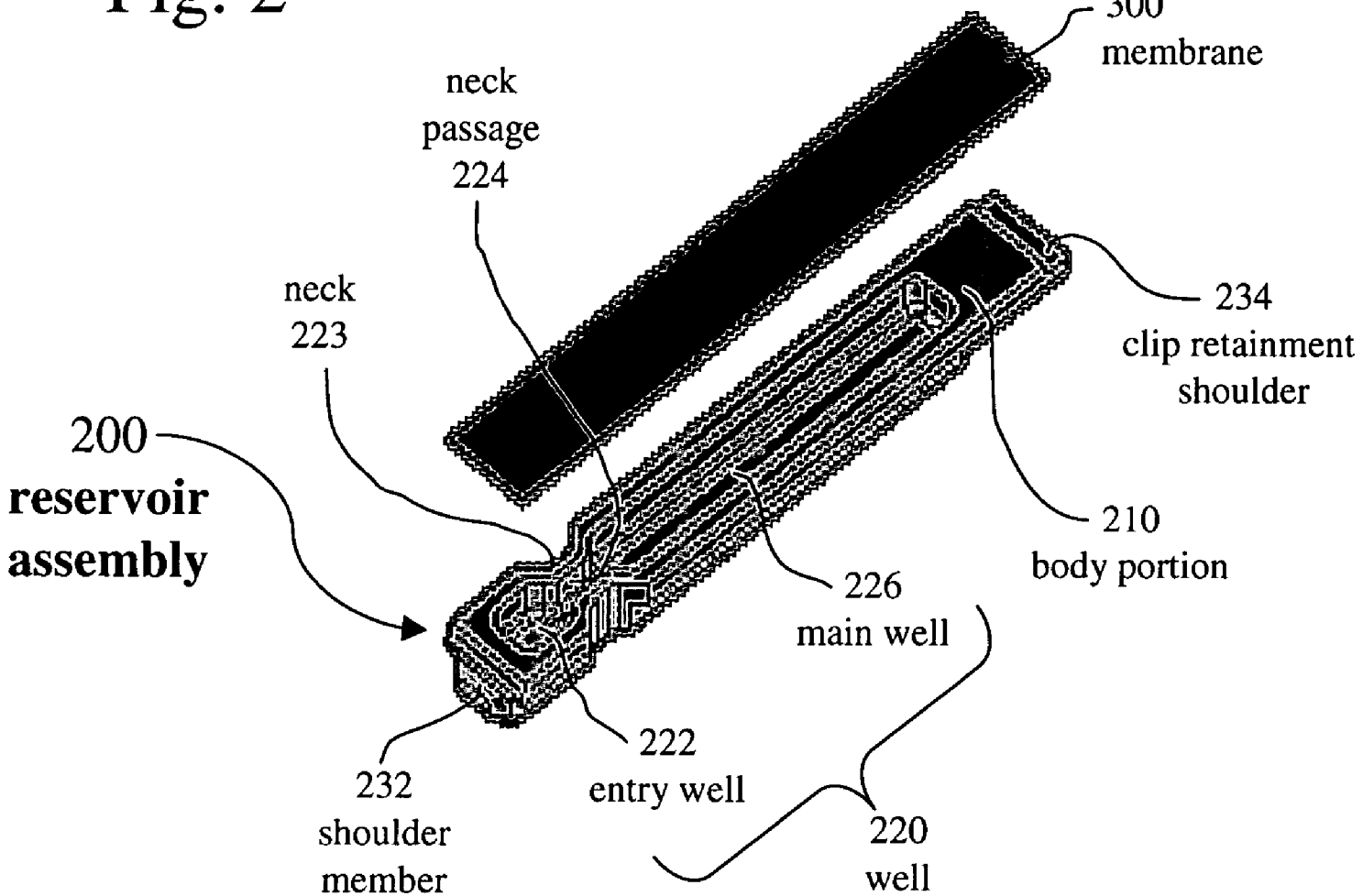
FIG. 2 is a perspective view of a reservoir assembly in accordance with one embodiment of the invention.

FIG. 2 is a perspective view of a reservoir assembly in accordance with one embodiment of the invention. Each of the reservoir assemblies 200 shown in FIG. 1 may be of similar structure to that described below with reference to FIG. 2.

The reservoir assembly 200 of FIG. 2 may be elongated in shape as shown, and include a body portion 210. A well 220 is disposed in and formed by an interior cavity in the body portion 210. The well 220 runs along the length of the reservoir assembly 200. As shown in FIG. 2, the well 220 includes an entry well 222 and a main well 226. The entry well 222 and the main well 226 are connected by a neck passage 224. The neck passage 224 is formed by a narrowed portion of the body portion 210 that forms a neck 223.

The reservoir assembly 200 includes shoulder members that serve to secure the reservoir assembly 200 upon the base assembly 100. Specifically, the reservoir assembly 200 includes a shoulder member 232. The shoulder member 232 engages with a groove in the supporting bar 120. Further, the reservoir assembly 200 includes a clip retainment shoulder 234. The clip retainment shoulder 234, as shown in FIG. 1, is positioned adjacent the clip retaining bar 130. Accordingly, the clip retaining bar 130 buttresses the reservoir assemblies 200 from becoming disengaged from the supporting bar 120. Further, the reservoir retainer clip 190 is slid over the end of the clip retainment shoulder 234 of each reservoir assembly 200. Accordingly, each reservoir assembly 200 is prevented from "popping" up from the base assembly 100 once the reservoir retainer clip 190 is positioned over the clip retainment shoulder 234 of the particular reservoir assembly 200.

Once it is desired to remove a reservoir assembly 200 from the base assembly 100, the clip retainment shoulder 234 is slid so as to expose the clip retainment shoulder 234 of the particular reservoir assembly 200. At that point, the exposed end of the reservoir assembly 200 may be lifted, i.e., pivoted counter-clockwise as shown in FIG. 1. Once the end of the reservoir assembly 200 is lifted, the shoulder member 232 of the particular reservoir assembly 200 may be slid out of its respective groove in the supporting bar 120. The reverse procedure may be effected for positioning and securing a reservoir assembly 200 upon the base assembly 100.

As used as a test card assembly, in accordance with one embodiment of the invention, various functional design requirements may be required. Illustratively, such design requirements may include that each reservoir of the test card assembly 10 is provided to collect needle inoculation fluid for each of ten channels in the JBPDS System. Further, each reservoir is provided to contain and preserve the collected inoculation fluid for weight (i.e., mass) measurement. As a result, the test card assembly provides the ability to accurately determine the net weight measurement of inoculation fluid (by knowing the tare weight of each reservoir).

As described generally herein, the "weight" of fluid is determined. However, this determining more specifically means that the "mass" of fluid is determined. This might be performed by weighing with a mass balance, for example. Once the mass is determined, then the volume may be determined, i.e., by performing a (volume=mass/density) calculation.

The reservoir structural material is provided to not easily absorb and may be provided to be resistant to Phosphate Buffer Solution (PBS), which is typically used as sample solution in testing the JBPDS System. The reservoir may be provided to be re-useable after cleaning on the test card assembly. When used as a test card assembly, the design is constructed to satisfy the proper fit and function so as to effectively interface with the particular unit in which it is used. For example, this interface is affected by the support pedestals 152 and retaining notches 154, as shown in FIG. 1, for mechanized handling of the test cards by the unit in which the test card is inserted. Another design requirement may include that the reservoir membrane material (construction) shall be punctured cleanly by the needles such that the puncture flap does not impede the JBPDS System inoculation fluid flow into the reservoir well. Note that typically a small venting hole must be punctured in the membrane on each reservoir near the retaining clip end prior to inoculation testing to allow fluid to properly flow into each reservoir when punctured by the JBPDS System needle during testing.

The above design requirements are illustrative and should not be interpreted as limiting. It is of course appreciated that the particular design requirements, and the manner in which such design requirements dictate the structure of the invention, may be varied as desired, i.e., depending on the particular use of the fluid retaining assembly 10.

Figure 3:
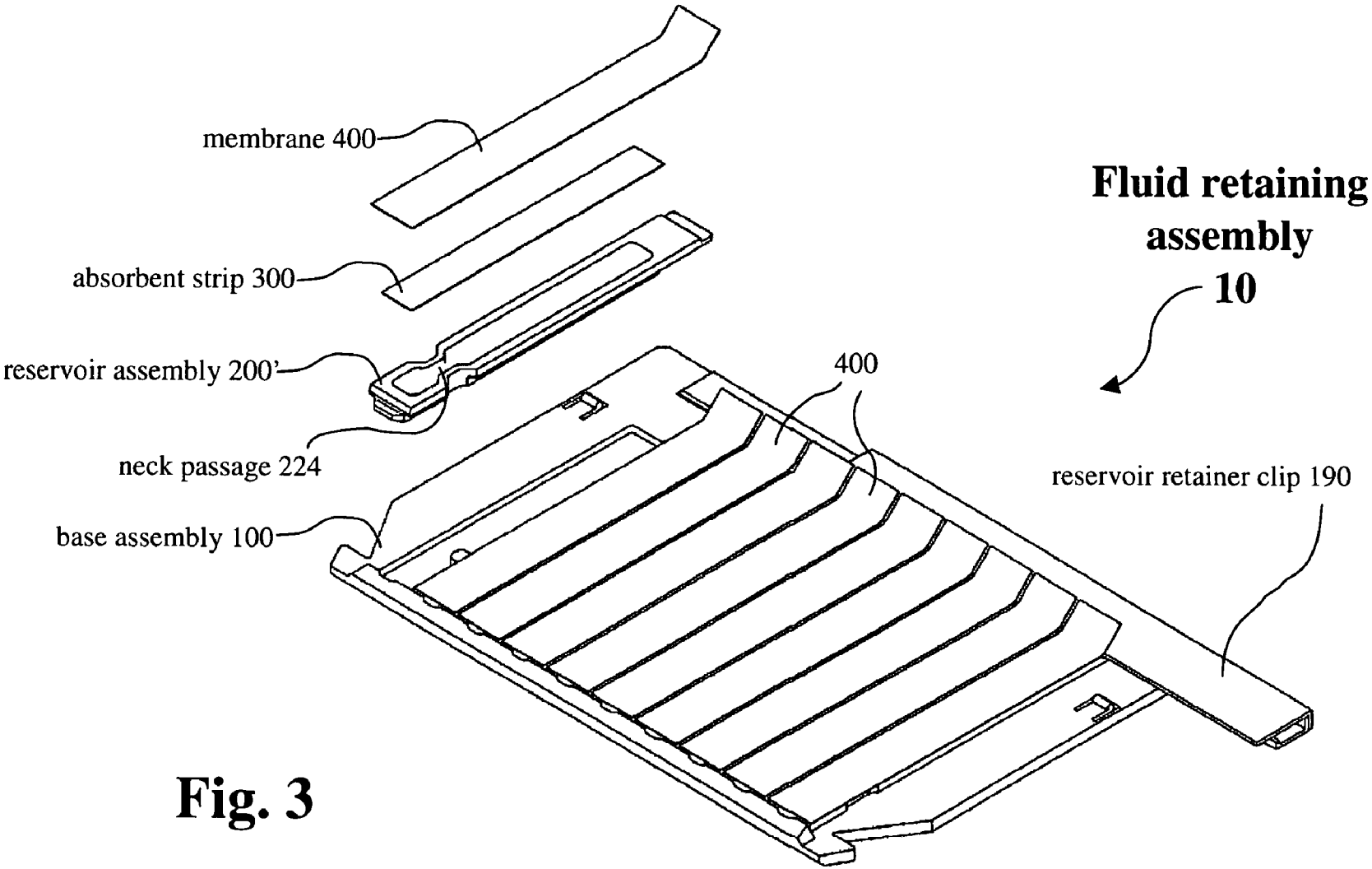
FIG. 3 is a further perspective view of a test card assembly showing further details in accordance with one embodiment of the invention.

Hereinafter, further details of the fluid retaining assembly 10 will be described with reference to the drawings. FIG. 3 is a perspective view of a test card assembly showing further details in accordance with one embodiment of the invention. FIG. 3 shows the base assembly 100 and a plurality of reservoir assemblies disposed therein, with one reservoir assembly 200' removed from the base assembly 100. An absorbent strip 300 may be positioned within the reservoir assembly 200'. The membrane 400 may be secured to the reservoir assembly 200 in any suitable manner, such as with acrylic or silicone adhesive, that prevents system contamination and does not interfere with the agent detection process during normal operation, so as to provide a sealed cover for the reservoir assembly. FIG. 3 also shows the end of the membrane tape tipped up slightly to allow for easier removal. In one embodiment of the invention, the membrane tape may exceed the width of the reservoir by about 0.1 inches so as to allow the membrane to also adhere to be folded over on the sides of the reservoir to increase sealing.

The absorbent strip 300 may be provided to be any suitable dimension or constructed of any suitable material, as desired. For example, the width of the absorbent strip 300 may be provided to correspond to the width of the neck passage 224, i.e., be narrower than shown in FIG. 3. Such width would ease placement of the absorbent strip 300 into the reservoir assembly 200'. Further, the length of the absorbent strip 300 may be such so as to extend from the neck area to the main part of the well. That is, for example, the absorbent strip 300 may extend from an end of the well 220 (in the entry well 222) to a middle portion of the main well 226. However, the length, width and any other dimensions of the absorbent strip 300 may be varied as desired.

In accordance with one embodiment of the invention, the absorbent strip 300 may be constructed of suitable litmus paper. Such absorbent strip 300 is provided to visually identify properties of fluids placed in the reservoir assembly 200'.

Figure 4:
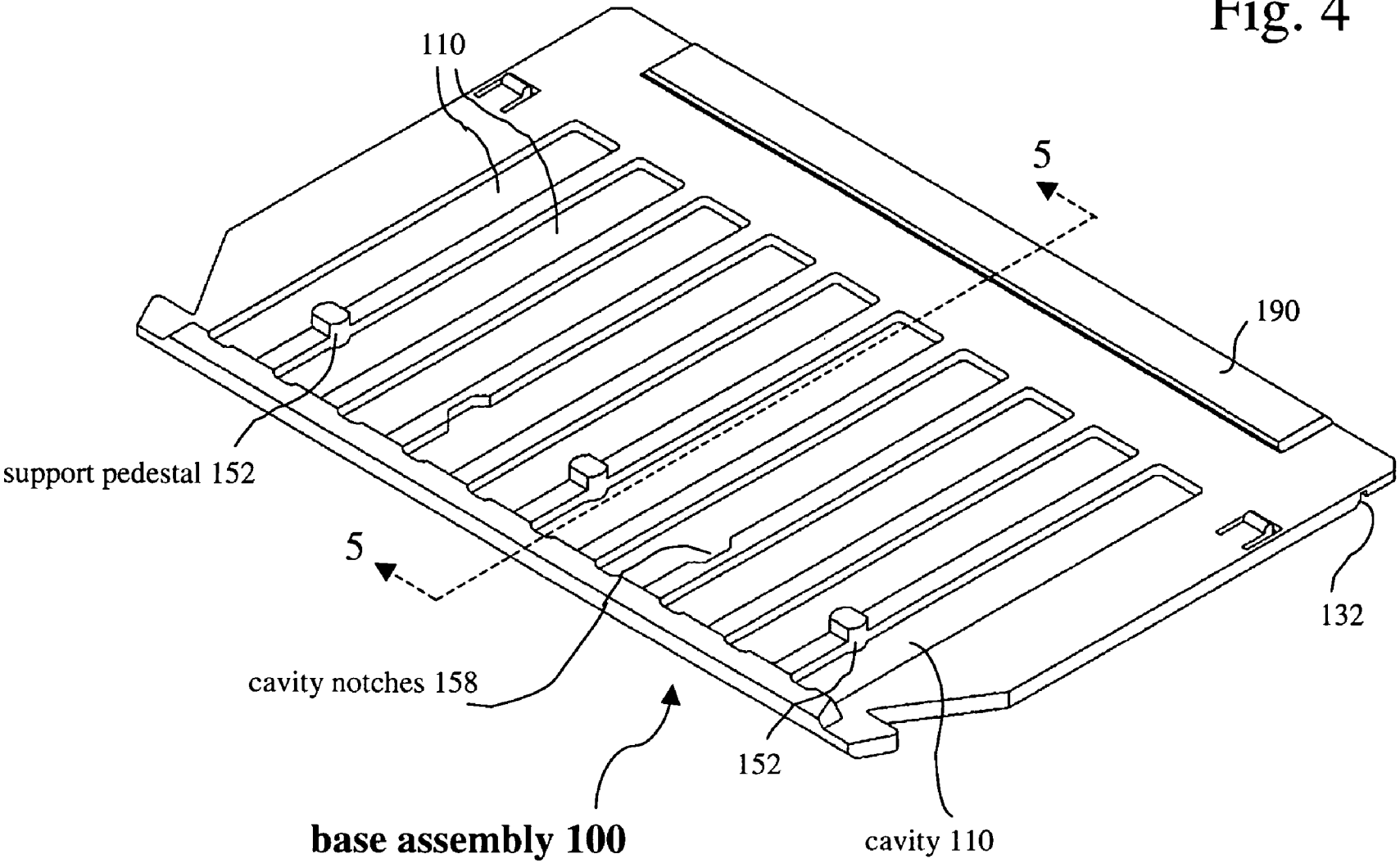
FIG. 4 is a perspective view of a base assembly, with the reservoir assemblies removed, in accordance with one embodiment of the invention.

FIG. 4 is a further perspective view of a base assembly 100 with the reservoir assemblies removed in accordance with one embodiment of the invention. FIG. 4 shows various features discussed above. Further, FIG. 4 shows details of the cavities 110 in the base assembly 100. Each of the cavities 110 may be formed by a recessed portion in the base assembly 100. Each cavity 110 is shaped to accept, at least a portion, of the lower portion of the particular reservoir assembly 200. The particular shape and dimensions used will of course depend upon the particular use of the fluid retaining assembly 10. As shown in FIG. 4, the base assembly 100 includes ten cavities 110 for receiving ten reservoir assemblies 200.

In general, the dimensions of the fluid retaining assembly 10 and the various components that make up the fluid retaining assembly 10 may be modified as desired or needed, e.g., depending on the particular use of the fluid retaining assembly 10. Further, the materials that are used to construct the fluid retaining assembly 10 and the various components that make up the fluid retaining assembly 10 may be modified as desired or needed. Accordingly, metal, plastic or any other suitable material may be used to construct the base assembly 100, the reservoir assembly 200, the absorbent strip 300, the membrane 400, as well as any other components.

The base assembly 100 also includes a plurality of support pedestals 152. As described above, the fluid retaining assembly 10, in accordance with one embodiment of the invention, is provided to be used in an inoculation unit. The support pedestals 152 serve to interface with the inoculation unit. Specifically, the support pedestals 152 are used in conjunction with, and to interface with, a holding mechanism in the inoculation unit. The holding mechanism might be in the form of a spring pad in the inoculation unit. Further, the base assembly 100 includes cavity notches 158. The two cavity notches shown on the base card in FIG. 4 are required in the design to clear JBPDS system venting pins that are used to pierce the membrane on the assay strip carrier prior to inoculation. Any other notches or clearances, for example, might be provided to interface with the particular system that the fluid retaining assembly 10 is utilized in.

Figure 5:
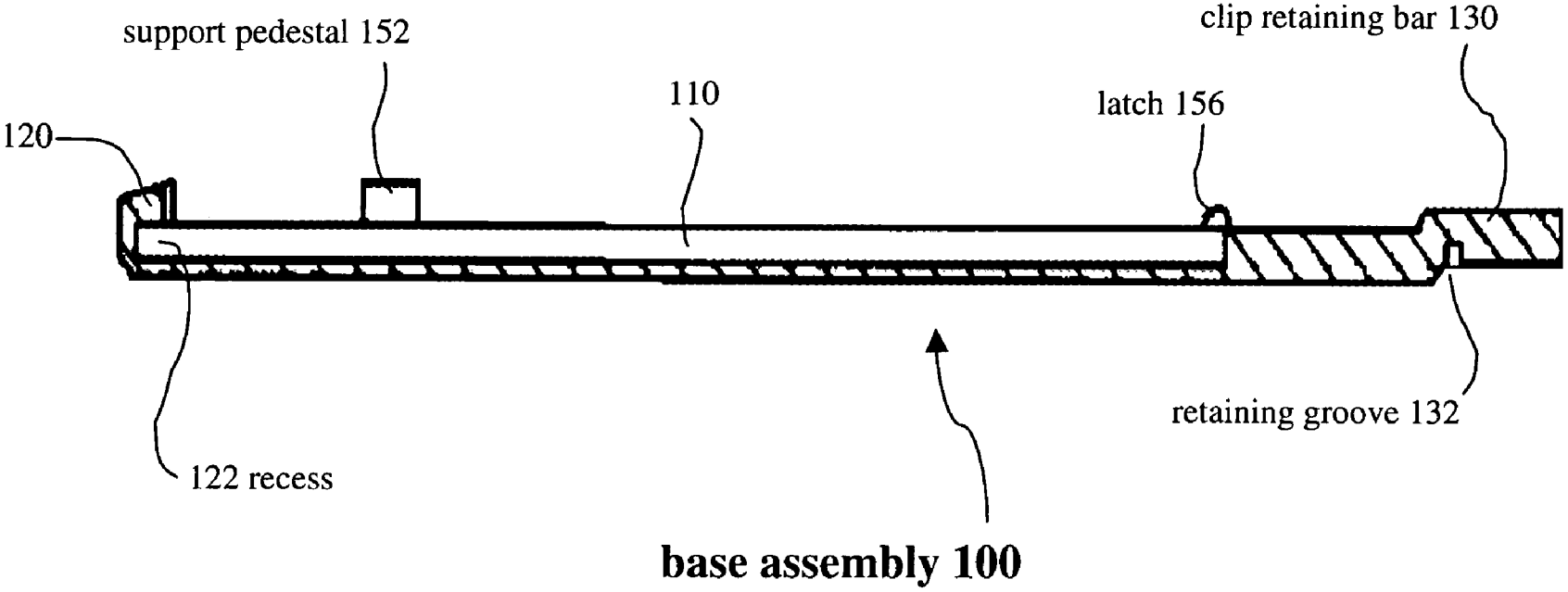
FIG. 5 is a cross-sectional view of a base assembly, along line 5-5 of FIG. 4, in accordance with one embodiment of the invention.

FIG. 5 is a cross-sectional view of a base assembly 100, along line 5-5 of FIG. 4, in accordance with one embodiment of the invention. As shown, the base assembly 100 includes the supporting bar 120 and the adjacent cavity 110. The base assembly 100 further includes the clip retaining bar 130.

FIG. 5 also shows a recess 122. The recess 122 is formed in the supporting bar 120 and integrally formed with the cavity 110. The recess 122 accepts the shoulder member 232 of the reservoir assembly 200. Once the shoulder member 232 of the reservoir assembly 200 is disposed in the recess 122, the end of the reservoir assembly 200 is prevented from upward movement, i.e., clockwise rotation as shown in FIG. 5. This, in conjunction with operation of the reservoir retainer clip 190, serves to the retain the reservoir assembly 200 upon the base assembly 100.

Figure 6:
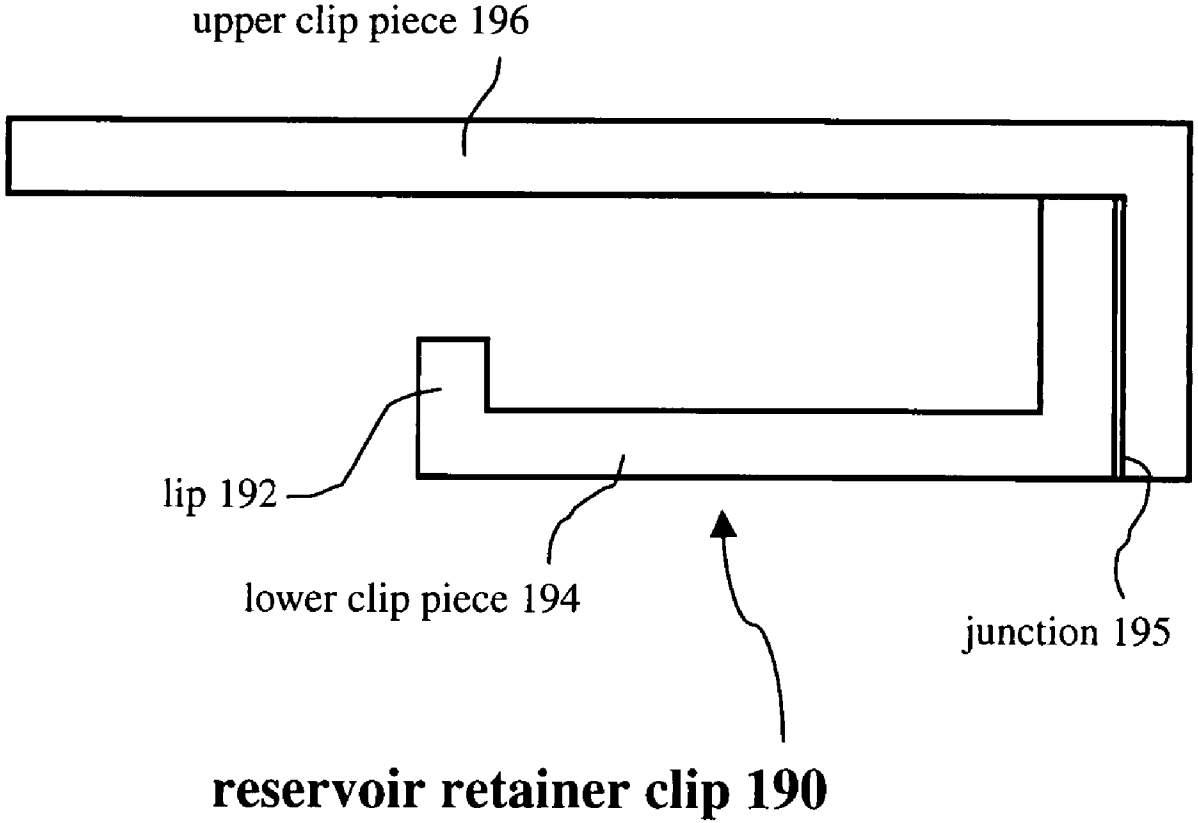
FIG. 6 is an end view of a reservoir retainer clip in accordance with one embodiment of the invention.

FIG. 6 is an end view of a reservoir retainer clip in accordance with one embodiment of the invention. As shown, the reservoir retainer clip 190 may be constructed of a lower clip piece 194 and an upper clip piece 196. The lower clip piece 194 and the upper clip piece 196 may be constructed of two respective pieces and then joined at a junction 195, i.e., by a suitable adhesive, for example. Alternatively, the reservoir retainer clip 190 may be formed of a single piece.

The lower clip piece 194 includes a lip 192. The lip 192 is disposed in the retaining groove 132 of the clip retaining bar 130. The upper clip piece 196 is disposed upon the clip retaining bar 130. In such manner, the reservoir retainer clip 190 is slidably disposed on the clip retaining bar 130 so as to selectively engage and disengage the clip retainment shoulder 234 of each reservoir assembly 200, as described above.

Figure 7:
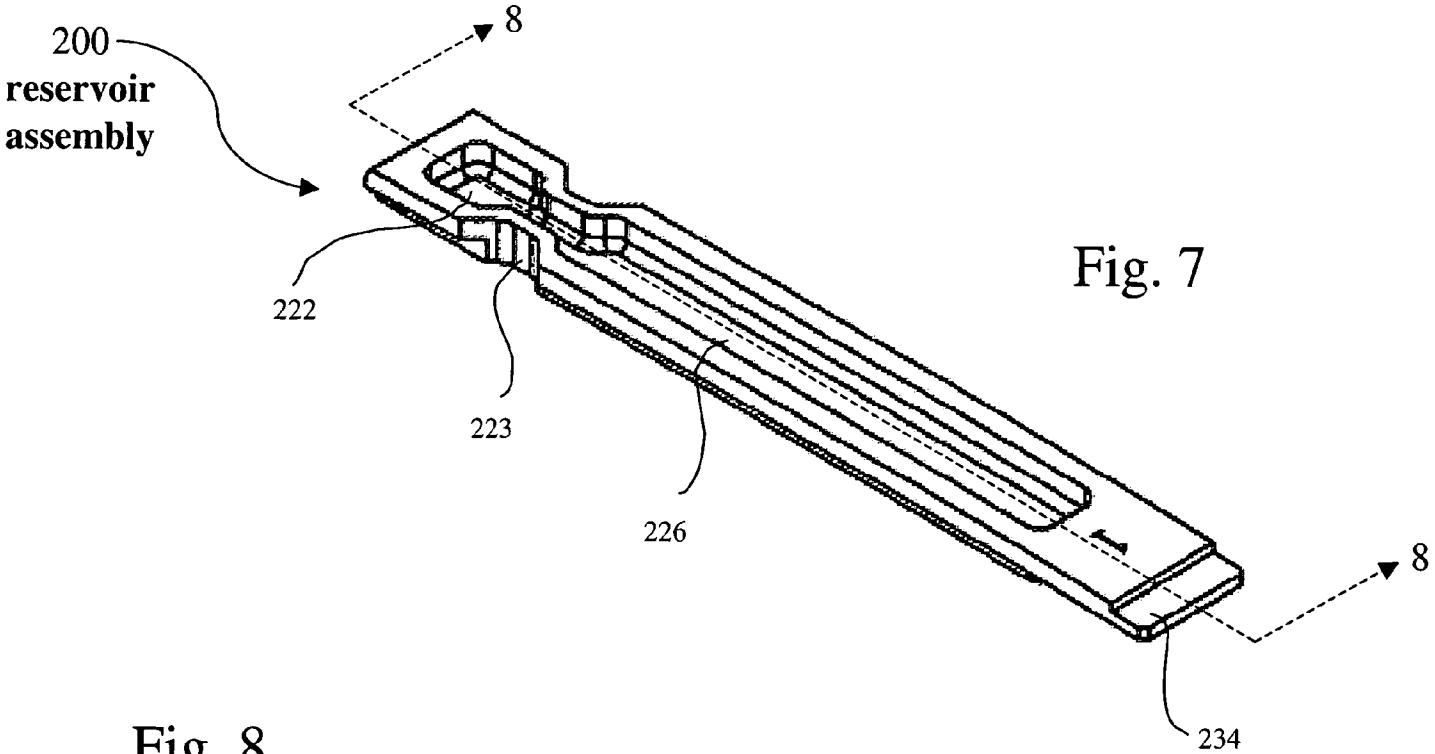
FIG. 7 is a further perspective view of a reservoir assembly in accordance with one embodiment of the invention.

FIG. 7 is a further perspective view of a reservoir assembly in accordance with one embodiment of the invention. Further, FIG. 8 is a cross-sectional view of a reservoir assembly, along line 8-8 of FIG. 7, in accordance with one embodiment of the invention.

Figure 8:
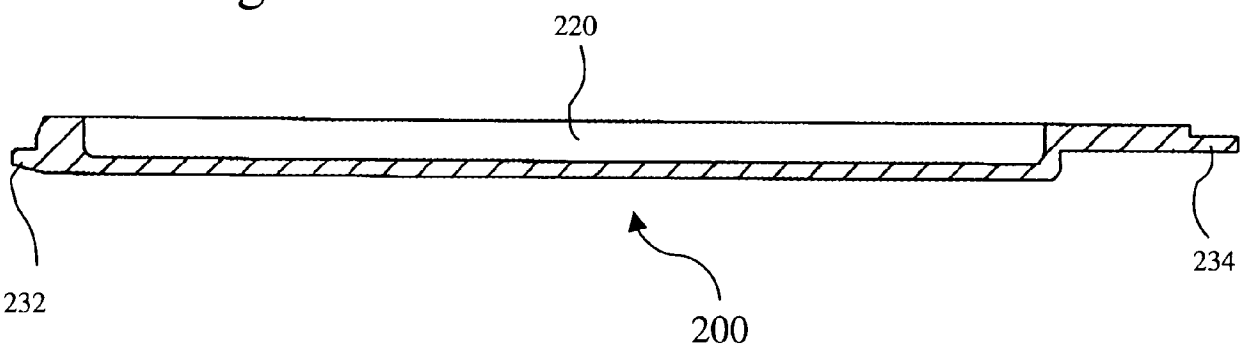
FIG. 8 is a cross-sectional view of a reservoir assembly, along line 8-8 of FIG. 7, in accordance with one embodiment of the invention.

FIGS. 7 and 8 further illustrate features of the reservoir assembly 200, in accordance with one embodiment of the invention. As shown, the well 220 includes the entry well 222 and the main well 226. The shoulder member 232 and the clip retainment shoulder 234 are provided to secure the reservoir assembly 200 to the base assembly 100, as described above.

As shown in FIG. 7, the reservoir assembly 200 may be provided with a numerical identifier, e.g. the number "1". In this manner, the various reservoir assemblies 200 associated with a particular base assembly 100 may be individually identified. This may be needed in that the weight of the reservoir assemblies 200, e.g. the tare weight, may differ.

Figure 9:
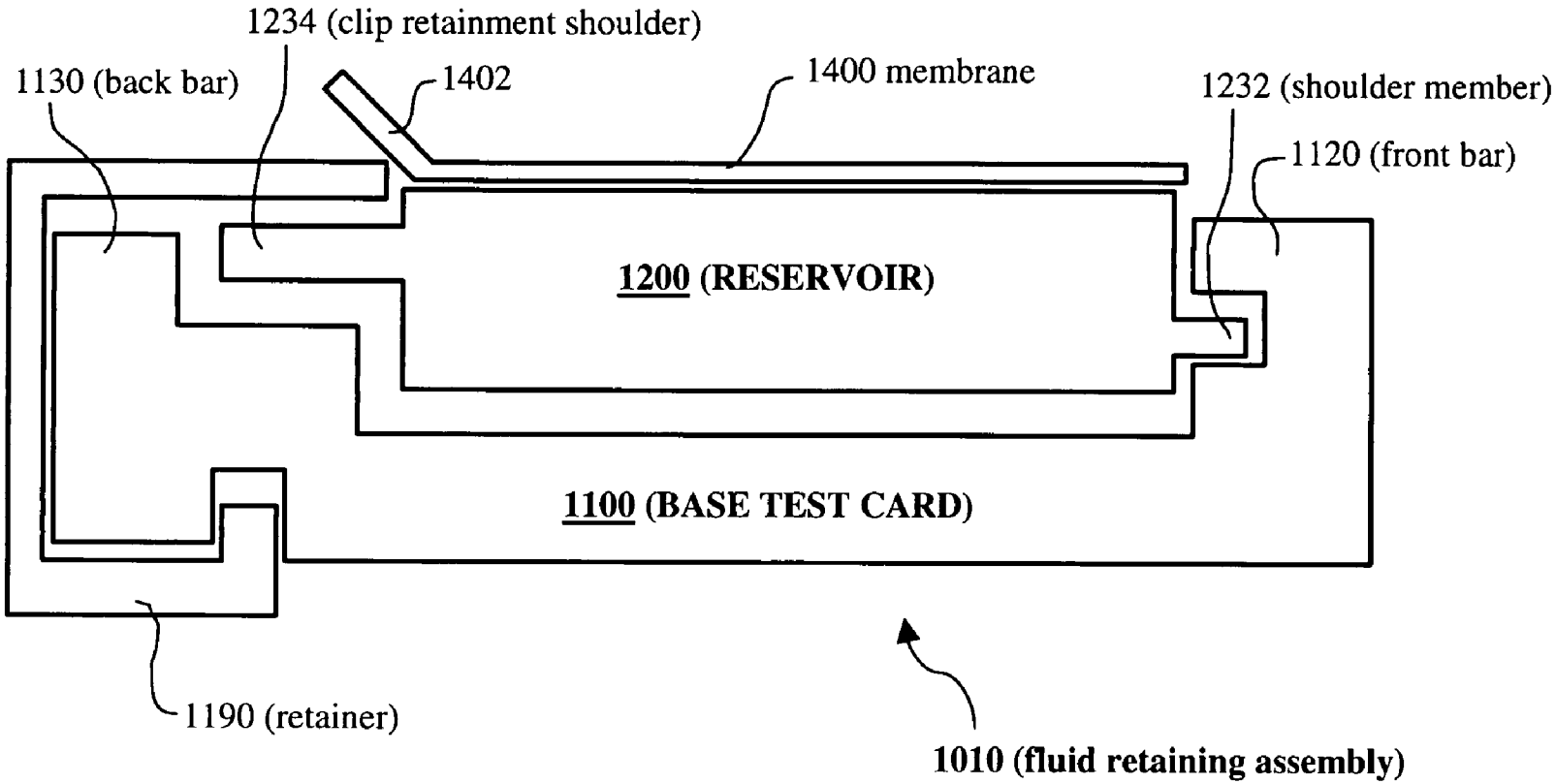
FIG. 9 is a schematic diagram of a fluid retaining assembly in accordance with one embodiment of the invention.

FIG. 9 is a schematic diagram of a fluid retaining assembly 1010 in accordance with an embodiment of the invention. As shown, the fluid retaining assembly 1010 includes a base assembly 1100 and a reservoir assembly 1200. Such components might be characterized as constituting a "base test card" and a "reservoir," respectively. Further, the fluid retaining assembly 1010 includes a reservoir retainer clip 1190, i.e., a retainer, and a membrane 1400.

In a manner similar to the embodiments discussed above, the base assembly 100 includes a front bar 1120 (i.e., a supporting bar) and a back bar 1130 (i.e., a clip retaining bar). The reservoir 1200 includes a shoulder member 1232 and a clip retainment shoulder 1234. As shown, the shoulder member 1232 of the reservoir 1200 is received into the front bar 1120 of the base test card 1100. On the other end, the clip retainment shoulder 1234 rests on the back end of the base test card 1100, and is retained by the reservoir retainer clip 1190. The reservoir retainer clip 1190 is slidably disposed on the back bar 1130, in a manner described above. In particular, FIG. 9 is provided to shown the geometrical interrelationship between the various components of the fluid retaining assembly 1010.

As described above, the membrane 1400 is disposed upon the reservoir 1200. As shown in FIG. 9 (as well as 3), a backend 1402 of each membrane 1400 may be bent up. Such arrangement provides a tab of sorts by which each membrane 1400 is removed from the reservoir 1200. Further, by the backend 1402 being bent up, such arrangement allows the reservoir retainer clip 1190 to freely slide on the back bar 1130 in an unobstructed manner.

Figure 10:
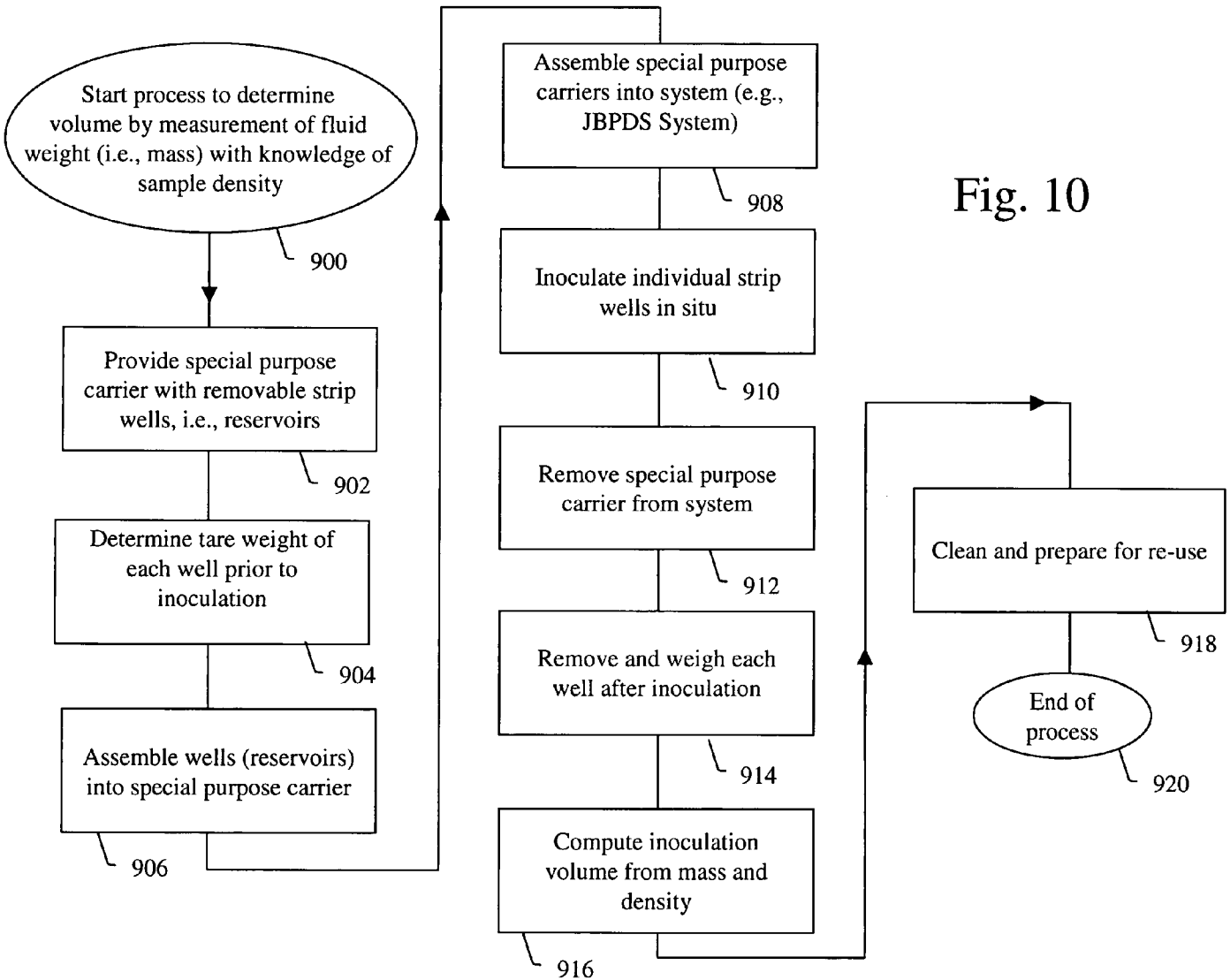
FIG. 10 is a flow chart showing a process of using the test card assembly in accordance with one embodiment of the invention.

In further illustration of the invention, FIG. 10 is a flow chart showing a process of using the test card assembly in accordance with one embodiment of the invention. In particular, FIG. 10 shows a process to determine volume of a fluid, by measurement of fluid weight based on a knowledge of the sample density. As shown in FIG. 10, the process starts in step 900 and passes to step 902.

In step 902, a special purpose carrier with removable strip wells, i.e., reservoirs, is provided. For example, the fluid retaining assembly 10 of FIG. 1 may be used. Note that as used herein, the terms "wells" and "reservoirs" have generally been used interchangeably. After step 902, the process passes to step 904. In step 904, the process includes determining the tare weight (mass) of each well prior to inoculation.

Then, in step 906, the reservoirs are assembled into a special purpose carrier, e.g. the fluid retaining assembly 10. In step 908, the special purpose carrier is placed into a JBPDS System. Then, in step 910, the individual strip wells are inoculated in situ. After step 910, the process passes to step 912.

In step 912, the special purpose carrier is removed from the JBPDS System. Then, in step 914, each well is removed from the carrier and weighed, i.e., its mass is determined. This might be performed using a mass balance, for example. Then, the process passes to step 916. In step 916, the inoculation volume is computed from the mass and density of the inoculate, i.e., based on a weighing of the inoculated well vis-à-vis the tare weight and (using a volume=mass/density calculation).

Thereafter, the process passes to step 918. In step 918, the carrier and wells are cleaned and prepared for re-use. In step 920, the process ends. The reservoir well may have an absorbent strip to contain the fluid during handling to minimize evaporation after fluid collection. Other functions of the absorbent strip are to draw fluid out of the entry well while minimizing splashback during the inoculation process.

In use as a test card assembly, various measurement performance requirements may be imposed on the structure, in accordance with one embodiment of the invention. Illustratively, a measurement performance requirement may be that the reservoir well shall hold a minimum of 125 microliters and a maximum of 200 microliters. The reservoir well may have an absorbent strip to contain fluid during handling to minimize evaporation after fluid collection. The reservoir may have a top membrane seal that minimizes evaporation, adheres well to the reservoir material, and is easy to apply and remove for cleaning. The test assembly may be constructed such that a reservoir cannot be installed in the test base card incorrectly, and such that the reservoir can be easily removed for weight measurement after removal of the retainer slide-on clip from rear of base card, i.e., after removal of the reservoir retainer clip 190. The reservoir well and membrane may be provided to be conductive to preclude any ESD charge build-up, or other charge build-up, for one embodiment of the invention so as not to affect the accuracy of the weight measurement of each individual reservoir.

Hereinafter further aspects of possible interface requirements of the test card assembly will be further described, in accordance with one embodiment of the invention. When used as a test card assembly, the fluid retaining assembly 10 shall provide proper interface to a JBPDS system, or other system in which it is used. The fluid retaining assembly 10 may be provided to have spring retainer clips (i.e., the latch 156 shown in FIG. 1) to hold the test card in a carrier box assembly, which has horizontal slots to store the test cards. That is, a number of the test cards may be retained in a suitable carrier box unit. Further, the fluid retaining assembly 10 might alternatively be stored and/or used in a holder that does not utilize any particular retainment mechanism. Thus, the latch 156 and the retaining notches 154, for example, might not be needed.

For example, a carrier box assembly might hold up to ten assay strip carriers in the JBPDS System. During normal operation of the JBPDS System, the JBPDS System pulls an assay strip carrier out of the carrier box assembly to test for certain biological agents. To test inoculation volume, the test card is placed in the next slot to be used (typically slot 2 through slot 10) in the carrier box assembly prior to testing. Therefore, the carrier box assembly stores the test card assembly prior to being used by the JBPDS System, i.e., to test the JBPDS System inoculation. The reservoir neck area (of the test card) may be required in this design to clear the two JBPDS System venting pins that are used to pierce the membrane on the assay strip carrier prior to inoculation. The test card may be provided to have pedestal posts in three locations, for example, to interface the spring holding pads (in the JBPDS System) that press down on top of the base card to hold it in place during testing. The test card may be provided to have two latching slots (i.e., the retaining notches 154) to allow the JBPDS System to grab hold of and control position of test card in the JBPDS System. The reservoir membrane may be provided to have an acrylic adhesive since this material will not contaminate the JBPDS System needles prior to use with the assay strip carrier for biological detection. Various other interface requirements may be imposed, as desired or needed.

The fluid retaining assembly 10 may be constructed of any suitable materials as desired. For example, the base assembly 100 and reservoir retainer clip 190 may be made from Lexan® 9440. The retainer, i.e., the reservoir retainer clip 190, may be glued together from two over-lapping pieces with Loctite® 770 18386 Primer and 454 adhesive PN 45440. The reservoirs 200 may be made of 304 stainless steel and have a 32 (or better) micro inch polished top rim surface to provide a good adhesion to and sealing for the top membrane tape. The membrane 400 may be silver metalized polyester film tape with acrylic adhesive (having the equivalent or better sealing performance of 3M® Tape 850). An alternate membrane such as 3m Tape 8901 Composite Bond Tape may also be used. The 3M tape 8901 is a polyester film tape with silicone adhesive. However, other material may of course be used, as desired. When the membrane is applied, from a standard width tape ½" wide tape roll, that the extra width can be folded over the top edges of the reservoir such that it adheres to the sides of the top lip to increase the sealing of the membrane to the top of the reservoir. In accordance with one embodiment of the invention, it is important that the test card functions as one assembly that stays together as one during handling and testing of inoculation volume.

The ability of the test cards to be re-usable is an important point in some embodiments. The test card described herein is easy to disassemble for cleaning by sliding off the reservoir retainer clip, rotating each reservoir upward and out from the front supporting bar. The tape is removed from each reservoir, the collected PBS solution can be disposed of in the industrial chemical waste, and the reservoirs can be cleaned with a germicidal disposable cloth such as PDI Sani-Cloth Plus. The reservoirs are then allowed to dry properly prior to re-use.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A fluid retaining assembly comprising:

a base assembly including a cavity within the base assembly;

a reservoir assembly disposed in the cavity of the base assembly, the reservoir assembly including a body portion having a well in which fluid is retainable and a membrane covering the well, wherein at least a portion of the body portion is disposed within the cavity of the base assembly, the reservoir assembly further including an absorbent strip disposed in the well and covered by the membrane; and the base assembly including at least one attachment member, the attachment member serving to attach the reservoir assembly to the base assembly;

wherein the attachment member of the base assembly includes a recess, and the reservoir assembly includes a shoulder member, the shoulder member disposed in the recess of the base assembly when the reservoir assembly is disposed in the cavity of the base assembly.

2. The fluid retaining assembly of claim 1, where the well includes an entry well, a main well, and a neck passage connecting the entry well and the main well, the neck passage defined by a neck in the body portion.

3. The fluid retaining assembly of claim 1, further including a plurality of reservoir assemblies disposed side by side, each of the plurality of reservoir assemblies being individually separable from the base assembly;

the cavity of the base assembly supports each of the reservoir assemblies; and the base assembly includes at least one support pedestal, the at least one support pedestal disposed in the neck of at least two adjacent reservoir assemblies.

4. The fluid retaining assembly of claim 1, wherein the absorbent strip is formed of litmus paper.

5. The fluid retaining assembly of claim 1, wherein the base assembly includes a supporting bar, and the recess is formed in the supporting bar.

6. The fluid retaining assembly of claim 5, wherein the supporting bar is disposed along one side of the base assembly, and the base assembly further including a clip retaining bar extending along an opposing side of the base assembly from the supporting bar; and the fluid retaining assembly further including a reservoir retainer clip, the reservoir retainer clip mounted on the clip retaining bar; and the reservoir retainer clip engaging with the reservoir assembly to secure the reservoir assembly in the cavity of the base assembly.

7. The fluid retaining assembly of claim 6, wherein the reservoir assembly includes a clip retainment shoulder, the clip retainment shoulder of the reservoir assembly engaging with the reservoir retainer clip.

8. The fluid retaining assembly of claim 7, wherein the reservoir retainer clip is slidable along the clip retaining bar so as to engage and disengage with the reservoir assembly.

9. The fluid retaining assembly of claim 8, wherein the clip retaining bar includes a retaining groove in which a lip of the reservoir retainer clip is disposed and slidable within.

10. The fluid retaining assembly of claim 9, wherein the reservoir retainer clip includes the lip and a U-shaped body, the U-shaped body forming an interior channel in which the clip retaining shoulder is disposed.

11. The fluid retaining assembly of claim 1, further including a plurality of reservoir assemblies disposed side by side, each of the plurality of reservoir assemblies being individually separable from the base assembly.

12. The fluid retaining assembly of claim 1, wherein the base assembly further includes a pair of retaining notches disposed along respective opposing sides of the base assembly, the retaining notches providing an interface by which to manipulate the fluid retaining assembly.

13. The fluid retaining assembly of claim 12, further including a pair of latches disposed on the respective opposing sides of the base assembly, each latch providing a securement device to retain the fluid retaining assembly.

14. The fluid retaining assembly of claim 1, wherein the membrane is formed of tape.

15. The fluid retaining assembly of claim 14, wherein the tape is one of a silver metalized polyester film tape with acrylic adhesive and a polyester film tape with silicone adhesive.

16. The fluid retaining assembly of claim 1, in combination with an inoculation unit.

17. A fluid retaining assembly comprising:

a base assembly including a cavity within the base assembly;

a reservoir assembly disposed in the cavity of the base assembly, the reservoir assembly including a body portion having a well in which fluid is retainable and a membrane covering the well, wherein at least a portion of the body portion is disposed within the cavity of the base assembly, the reservoir assembly further including an absorbent strip disposed in the well and covered by the membrane; and the base assembly including at least one attachment member, the attachment member serving to attach the reservoir assembly to the base assembly;

wherein the attachment member of the base assembly includes a recess, and the reservoir assembly includes a shoulder member, the shoulder member disposed in the recess of the base assembly when the reservoir assembly is disposed in the cavity of the base assembly;

wherein the base assembly includes a supporting bar, and the recess is formed in the supporting bar; and wherein the supporting bar is disposed along one side of the base assembly, and the base assembly further including a clip retaining bar extending along an opposing side of the base assembly from the supporting bar;

the fluid retaining assembly further including a reservoir retainer clip, the reservoir retainer clip mounted on the clip retaining bar; and the reservoir retainer clip engaging with the reservoir assembly to secure the reservoir assembly in the cavity of the base assembly.

18. The fluid retaining assembly of claim 17, including a plurality of reservoir assemblies disposed on the base assembly.

* * * * *